United States Patent [19]

Winter et al.

[11] Patent Number: 4,471,635

[45] Date of Patent: Sep. 18, 1984

[54] SLIDER NEEDLES FOR WARP KNITTING MACHINES

[75] Inventors: Karl Winter, Obertshausen; Walter Branke, Rodgau, both of Fed. Rep. of Germany

[73] Assignee: Karl Mayer Textilmaschinenfabrik, GmbH, Fed. Rep. of Germany

[21] Appl. No.: 427,124

[22] Filed: Sep. 29, 1982

[30] Foreign Application Priority Data

Nov. 4, 1981 [DE] Fed. Rep. of Germany ..... 3143743

[51] Int. Cl.[3] ..... D04B 35/04

[52] U.S. Cl. ..... 66/120

[58] Field of Search ..... 66/120, 116, 123

[56] References Cited

U.S. PATENT DOCUMENTS

| | | | |
|---|---|---|---|
| 1,475,182 | 11/1923 | Hanes | 66/120 |
| 1,662,281 | 3/1928 | Scott | 66/120 |
| 4,222,249 | 9/1980 | Winter | 66/120 |
| 4,363,224 | 12/1982 | Wunner | 66/120 |

*Primary Examiner*—Ronald Feldbaum

[57] ABSTRACT

There is provided a slider needle for warp knitting machines, comprising a slider. The slider is guided by the opposing side walls of a slot cut in the front face of a needle shaft. The opening of the slot carrying the slider, opposite the slot base, is widened or flared in such a manner that there is provided such a separation as to prevent contact between the slider and the forward portion of the slot wall. Thus, abrasion of the forward face into sharp edges which could negatively affect the stitch threads is thereby avoided.

7 Claims, 4 Drawing Figures

SLIDER NEEDLES FOR WARP KNITTING MACHINES

BACKGROUND OF THE INVENTION

1. Field of the Invention

The present invention relates to slider needles for warp knitting machines comprising a slider which is guided between the side walls of a slot in the forward face of the needle shaft.

2. Discussion of the Relevant Art

In known slider needles of the foregoing type (DE-PS1760140) it is known to provide both the slider and the slot with parallel side walls. The slot breadth is slightly larger than the slider thickness so that the slider may rest entirely across its entire height, in the said slot. The edges of the slot meeting the forward surface of the needle shaft are rounded to avoid sharp edges. The closing portion of the slider is comparatively short and is attached to a slider shaft protruding from the slot.

During use these sliders are subjected to substantial sideward forces. These forces cause the slider to rest on one or the other side wall. The friction caused by the reciprocated motion gives rise to abrasion at the junction of the side wall of the slot and its forward face. This eventually gives rise to sharp, knife-like edges which interfere with the stitches lying on the needle shaft so that either stripes are formed in the fabrics or the filaments of the stitch thread are damaged or even cut. This particular problem is well known and discussed in DD-PS14665. The solution provided previously has been in either constructing the slider to be so big that it protrudes from the slot, which has the disadvantage of providing an excessive cross section for the needle; or the slot is formed by the rearward side of the needle and the slider led to the hook side through an opening therein, which leads to difficulties both in construction and in use.

SUMMARY OF THE INVENTION

A slider needle for a warp knitting machine according to the principles of the present invention has a needle and a slider. The aforesaid needle has a needle shaft. This shaft has a forward face and a slot formed in the forward face. The slider is positioned in the slot. The slot is sized to allow longitudinal reciprocation therein by the slider. The slot has at a predetermined outer position proximate the forward face, a greater width than at a predetermined deeper position in the slot.

By employing apparatus of the foregoing type, the danger of negatively affecting the stitches on the needle shaft through abraded edges, is readily prevented from occurring during the normal life span of a slider needle. The slot carrying the slider is preferably widened at the slot opening. In one embodiment the widening is defined by angled, side-wall sections. It is also possible to use curved, side-wall segments.

It is also particularly advantageous to use embodiments wherein the widening comprising a shoulder contiguous to substantially parallel side-wall sections. In this latter embodiment the shoulder would have to be entirely abraded before the configuration of the forward face is altered.

BRIEF DESCRIPTION OF THE DRAWINGS

In order that the invention may be more fully understood, it will now be described, by way of example, with references to the accompanying drawings in which.

DESCRIPTION OF THE PREFERRED EMBODIMENTS

Figure 1:
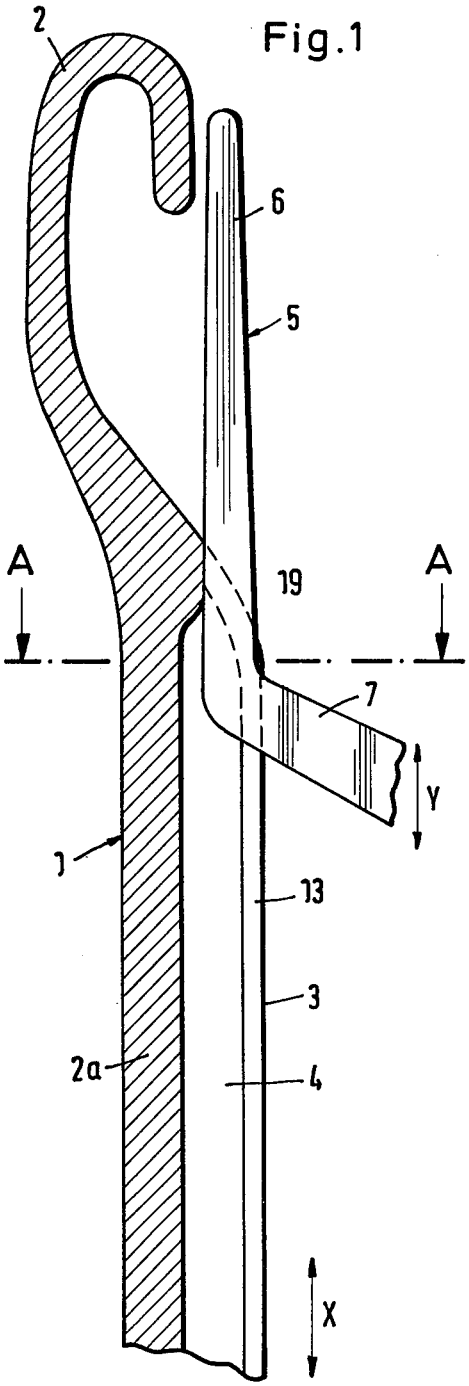
FIG. 1 is a side, elevational, cross-sectional view of a slider needle of the present invention.
Figure 2:
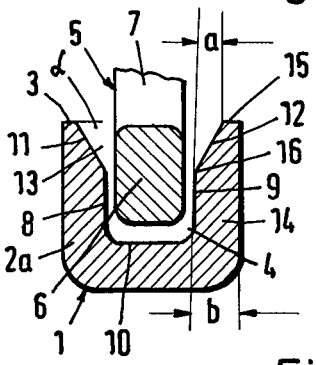
FIG. 2 is a cross-section along line A—A of FIG. 1.

Referring to FIGS. 1 and 2, slider needle 1 comprises hook 2 and needle shaft 2*a*. Slot 4, in which slider 5 runs, is cut in forward face 3 thereof. Slider 5 comprises closing portion 6 for the closing of the hook portion 2 and shaft 7 attached at an oblique angle to closing portion 6. The slider needle 1 reciprocates vertically in the direction of the double arrow X. Hook 2 has a centerline that diverges away from that of needle shaft 2*a* and then turns into opposition and alignment with shaft 2*a*. Slider 5 is vertically reciprocated in the direction of double arrow Y and is well known in warp knitting machines.

From FIG. 2 it may be seen that closing portion 6 of slider 5 has two parallel side walls and is generally shaped as a rectangle having rounded corners. Needle shaft 2*a* has a U-shaped cross-section. Slider portion 6 is positioned between parallel side wall segments 8 and 9 of slot 4 which are adjacent to slot bed 10. At slot bed 10 the width of slot 4 is only slightly larger than the width of the closing portion 6. At the opening of slot 4 are bevelled interior side wall segments 11 and 12 so that slot 4 is widened at location 13. The increase "a" in slot width on each side of the broadening is at least one half, or in the illustrated embodiment two thirds, of the thickness "b" of wall 14 of needle shaft 2*a*. Thus, there is provided on front side 3, a contact surface 15 which comprises a fraction of the wall thickness "b", in this embodiment comprising about one third. The angle $\alpha$ between the angled surfaces 11 and 12 and the plan provided by the forward surface 13 is of the order of 60°. Thus the walls of shaft 2*a* each subtend about 120° at forward face 3.

Advantageously, the open end of slot 4, opposite the base 10 of the slot in which the slider rests, is widened in such a manner that contact between slider 6 and the forward portion of the side walls 8 and 9 is avoided. Utilizing such a means of construction, when slider 1, influenced by the transverse forces exercised by the threads (not shown) is caused to lie against side walls 8 and 9 of slot 4 there is still sufficient separation between slider 6 and the forward portion of side walls 8 and 9. There is thus avoided any abrasion in the vicinity of the forward face 3.

Since slider 6 has parallel side surfaces 8 and 9, that portion of slot 4 adjacent to base 10 of the slot should have (preferably) a constant width and the broadening should be provided at that portion adjacent to forward face 3. This gives rise to a particularly cheap and simple construction. In order to provide for a particularly long operating life the decrease in dimension "b" (providing the widening on both sides of slot 4) should be more than one half and suitably about two thirds of the thickness of the needle shaft.

It is further advantageous that the widening of slot 4, commence at the curved contour 19 of the forward face, that is, at the slot exit proximate to hook 2. This ensures that undesired sharp edges are also avoided at this portion of the needle shaft. As a result, the slot width is longitudinally invariant.

During operation, the assembly of FIG. 1 can be wrapped and laterally biased by thread and can be shogged laterally. These lateral operations can produce sideward forces tending to press slider 5 against either wall segment 8 or 9. As slider 5 moves in slot 4, this back and forth motion causes an abrasion which commences at edge 16 (in the case of wall 14). In the life span of the needle 1 this edge moves along the angled surface 11 or 12 in an outwardly (upwardly) direction. Nevertheless, during the total life span of the needle a sufficient separation is provided from the forward front surface 15. Thus, there would be no influence upon any stitch pushed onto shaft 2*a*. The portion of the forward face 15 carrying the stitch therefore maintains its original shape. Even though the abrading action of the slider 5 eventually widens the dimension of slot 4 within which it runs, this creates no difficulties since it is possible to choose the original widening so that during the normal life of a slider needle the dimensions and conditions at the forward face 15 are substantially unchanged.

It has further been found advisable that the side wall at the widened portion of slot 4 subtend an angle $\alpha$ of at least 45° with the level defining the forward face 15. This ensures that even towards the end of the life of slider needle 1, that the outer portion of slot 4 influenced by abrasion still maintains a sufficient separation from the forward face.

Figure 3:
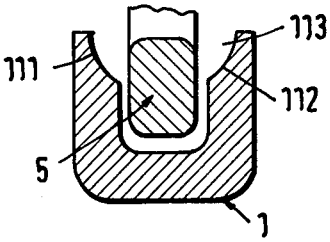
FIG. 3 is a cross-sectional view of a slider needle which is an alternate to that of FIG. 2.

The embodiment of FIG. 3 may be differentiated from that of FIG. 2 in that the broadening 113 is bordered by curved surfaces 111 and 112. In particular, by utilizing concave curved surfaces the angle $\alpha$ (FIG. 2) may be increased. Surfaces 111 and 112 are shaped as interior, concave bevels at the ends of the U-shaped cross-section of needle 1.

Figure 4:
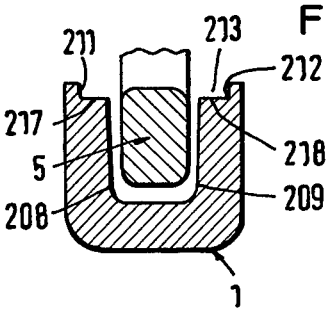
FIG. 4 is another cross-sectional view of a slider needle which is an alternte to that of FIGS. 2 and 3.

In FIG. 4, widening 213 is formed by two parallel, opposing ridge segments 212 and 211. Segments 211 and 212 are perpendicular and contiguous to shoulders 217 and 218, respectively. Shoulders 217 and 218 connect to the remaining portion of the slot. Also, here the remaining original side surfaces adjacent to the forward face remain intact over the entire life span of the slider needle. Furthermore the height of the guiding side wall segments 208 and 209 of the slot can be increased.

The manner of operation of the examples of FIGS. 3 and 4 are similar to those of FIGS. 1 and 2. As previously observed from FIG. 1 the broadened segment 13 runs over the entire length of slot 4 and is also found at the slot exit portion 19 adjacent to the hook. At this portion the widening 13 follows the curved contour of the forward face 3 so that the entire exit portion of the slot is covered thereby. A similar extension is provided for the slots of FIGS. 3 and 4.

It will be understood that various changes in the details, materials, arrangement of parts and operating conditions which have been herein described and illustrated in order to explain the nature of the invention may be made by those skilled in the art within the principles and scope of instant invention.

What is claimed is:

1. A slider needle for a warp knitting machine comprising: a slider having an opposing pair of parallel, lateral surfaces; and a needle having a needle shaft, said shaft having a forward face and a slot formed in said forward face straddled by a pair of opposing walls of substantially equal thickness and having an interior bed at its deepest position, said slider being positioned in said slot, said slot being sized to allow longitudinal reciprocation therein by said slider, said slot having an inner portion proximate to said interior bed having a uniform width; and an outer portion proximate to said forward face, contiguous to said inner portion and wider than said inner portion to provide walls of predetermined thickness, the differences in width between said inner portion and said outer portion being at least equivalent to the thickness of one of said walls at its thickest point.

2. A slider needle according to claim 1 wherein each of said walls taper by at least 50% in a direction toward said slot.

3. A slider needle according to claim 2 wherein said forward face forms a pair of obtuse angles with said slot, each of said obtuse angles subtended by said walls being less than 135°.

4. A slider needle according to claim 4 wherein the outer end of each of said walls has an interior, planar bevel.

5. A slider needle according to claim 1 wherein the outer end of each of said walls has an interior, concave bevel.

6. A slider needle according to claim 1 wherein each of said walls has an interior shoulder adjacent to a ridge, the ridge of one wall having an inside surface parallel to that of the other wall.

7. A slider needle according to claim 1 wherein said needle has a hook supported by said needle shaft, said hook having a centerline diverging from the centerline of said needle shaft at the juncture of said hook and needle shaft, said slot extending to and terminating at said hook, said slot being progressively shallower in a direction toward said hook, the width of said slot remaining invariant in a longitudinal direction up to its termination at said hook.

* * * * *